US006523260B2

(12) United States Patent
Kelsey

(10) Patent No.: US 6,523,260 B2
(45) Date of Patent: Feb. 25, 2003

(54) METHOD OF MAKING A SEAMLESS UNITARY BODY QUADRILATERAL HEADER FOR HEAT EXCHANGER

(75) Inventor: Richard Dwayne Kelsey, Claremore, OK (US)

(73) Assignee: Harsco Technologies Corporation, Fairmont, MN (US)

( * ) Notice: Subject to any disclaimer, the term of this patent is extended or adjusted under 35 U.S.C. 154(b) by 0 days.

(21) Appl. No.: 09/899,708

(22) Filed: Jul. 5, 2001

(65) Prior Publication Data

US 2003/0006029 A1 Jan. 9, 2003

(51) Int. Cl.[7] ..... B23P 15/26

(52) U.S. Cl. ..... 29/890.052; 29/890.03; 29/890.53; 29/890.054

(58) Field of Search ..... 29/890.052, 890.054, 29/428, 557, 890.03, 890.035, 890.043, 890.053, 890.07; 165/175, 95

(56) References Cited

U.S. PATENT DOCUMENTS

| | | | | |
|---|---|---|---|---|
| 2,044,457 A | | 6/1936 | Young | |
| 3,265,126 A | | 8/1966 | Donaldson | |
| 4,827,590 A | * | 5/1989 | Guerin | 375/362 |
| 4,932,469 A | | 6/1990 | Beatenbough | |
| 5,303,770 A | | 4/1994 | Dierbeck | |
| 5,383,517 A | | 1/1995 | Dierbeck | |
| 5,402,571 A | * | 4/1995 | Hosoya et al. | 29/413 |
| 5,706,887 A | | 1/1998 | Takeshita et al. | |
| 6,109,344 A | * | 8/2000 | Higgins | 165/140 |
| 6,155,339 A | | 12/2000 | Grapengater | |
| 6,167,953 B1 | * | 1/2001 | Kobayashi et al. | 165/173 |
| 6,189,606 B1 | * | 2/2001 | Chevallier | 165/173 |
| 6,223,812 B1 | * | 5/2001 | Gough | 165/173 |

* cited by examiner

*Primary Examiner*—I Cuda-Rosenbaum
(74) *Attorney, Agent, or Firm*—David C. Jenkins; Eckert Seamans Cherin & Mellott, LLC

(57) ABSTRACT

A header box for a heat exchanger includes a hollow unitary body having four generally flat sides forming a generally quadrilateral cross-section. End plates are located at, and coupled to, each end of the unitary body. One generally flat side has a plurality of plug openings located. The flat side opposite the one generally flat side having the plug openings includes a plurality of tube openings.

3 Claims, 4 Drawing Sheets

METHOD OF MAKING A SEAMLESS UNITARY BODY QUADRILATERAL HEADER FOR HEAT EXCHANGER

BACKGROUND OF THE INVENTION

1. Field of the Invention

The invention relates to headers for air-cooled heat exchangers and, more specifically, to a header having a generally square or rectangular unitary body, i.e. a weldless body.

2. Description of the Related Art

Air-cooled heat exchangers are frequently used in industrial applications. A fluid, either a gas or a liquid, is passed through a series of cooling tubes while air is mechanically passed over the exterior of the cooling tubes. The air absorbs heat from the cooling tubes thereby lowering the temperature of the fluid within the tubes. The cooling tubes may include lateral or axial fins to aid in heat transfer.

Heat exchangers typically include two header boxes having the cooling tubes extending therebetween. The header boxes are formed from a hollow body, each of which have a plurality of ports which allow fluid communication with the cooling tubes. One header box is connected to an inlet coupling and, typically, the other header box is connected to an outlet coupling. Within the body, pass plates may be disposed between groups of cooling tubes ports so that, a fluid entering the first header through the inlet conduit must follow a serpentine path, back and forth through the cooling tubes between the headers, to reach the outlet coupling.

Headers have many common cross-sectional shapes, for example, a quadrilateral, that is rectangular or square, round, oval and even obround. There are problems with header boxes of existing art. A quadrilateral header is typically formed by welding flat plates together. Each of the seams between the plates must be welded. These long corner welds result in significant fabrication time and expense. These welds, however, may fail, either in use or in testing prior to use. Additionally, because a quadrilateral header has generally right angle corners at the welds, the header is subject to stress concentrations which are localized along the welds. Thus, because stress concentrations contribute to potential failure of the header, it is preferable to have unwelded or curved surfaces in pressure vessels.

A header having a circular, oval, or obround cross-section does not have a large stress concentrations like a quadrilateral header does. A circular or oval header does, however, have other problems. For example, the cooling tubes are typically parallel to each another. Thus, when drilling cooling tube openings in a circular or oval header, the drill bit must be maintained in single plane, regardless of where on the perimeter the drill is located. Maintaining the alignment of the drill makes drilling difficult at the top and bottom of a circular or oval header. Similarly, it is more difficult to attach cooling tubes to a curved surface than it is to attach the cooling tubes to a flat surface.

Another problem in circular or oval headers is that, where threaded flat head shoulder plugs are used to plug access holes, the flat underside of the plug head does not fully engage the curved surface of the header. Thus, to provide an adequate sealing surface, the header may require spot face machining to provide flat surface for the plug to engage. Machining the header reduces the minimum thickness of the header wall in the area of the plug. Thus, the entire header may have to be manufactured with an additional material thickness to contain a specified pressure.

The invention of the obround header solved some, but not all, of these problems and has its own disadvantages. An obround header has a unitary body with two flat opposing vertical sides which are connected by two curved opposing sides. The openings for the cooling tubes and plugs are located on the two flat sides. Thus, the drilling of the openings for the cooling tubes and the plug is simplified and the cooling tubes and plugs are more easily coupled to the header. Because the header is made from a unitary body, there are no weld seams except at the ends where end plates are attached. The inlet coupling and outlet coupling, however, must still be coupled to one of the curved sides. The coupling must be specially formed to match the curved sides and attaching the coupling to the curved side is difficult. Additionally, the obround shape makes installation of the pass plates more difficult. Also, because the curved sides extend above and below the plane of the cooling tubes, the obround header requires more space than a traditional quadrilateral header.

There is, therefore, a need for a header for a heat exchanger having a unitary body having a quadrilateral cross-sectional shape.

There is a further need for a header for a heat exchanger having one set of opposing, flat sides having openings therethrough which are structured to be coupled to either cooling tubes or plugs, and a second set of opposing, flat sides having openings therethrough that are structured to be coupled to an inlet coupling or an outlet coupling.

SUMMARY OF THE INVENTION

These needs, and others, are satisfied by the invention which provides a header box having a unitary body which has a generally hollow, quadrilateral cross-sectional shape. The body has two sets of generally flat, parallel, opposing sides. The openings for the cooling tubes and the plugs are located on one set of opposing sides. An opening for a inlet or outlet coupling is located on one side of the second set of opposing sides. Other openings, e.g., for a temperature probe, may also be located on one of the sides in the second set of opposing sides.

BRIEF DESCRIPTION OF THE DRAWINGS

These and other advantages of the present invention will become readily apparent upon consideration of the following detailed description and attached drawings, wherein.

DESCRIPTION OF THE PREFERRED EMBODIMENT

Figure 1:
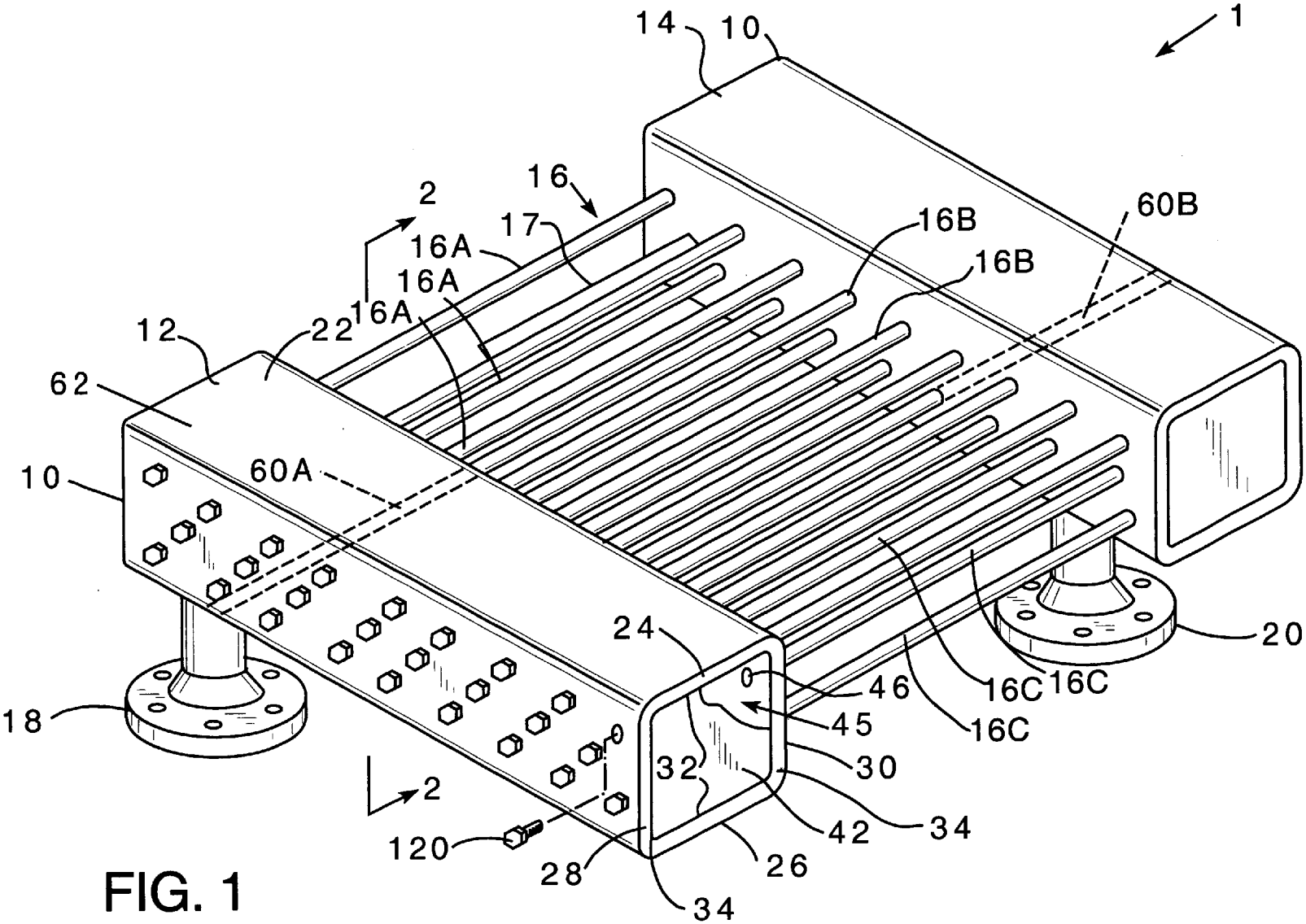
FIG. 1 is an isometric view of a unitary body quadrilateral header assembly.
Figure 2:
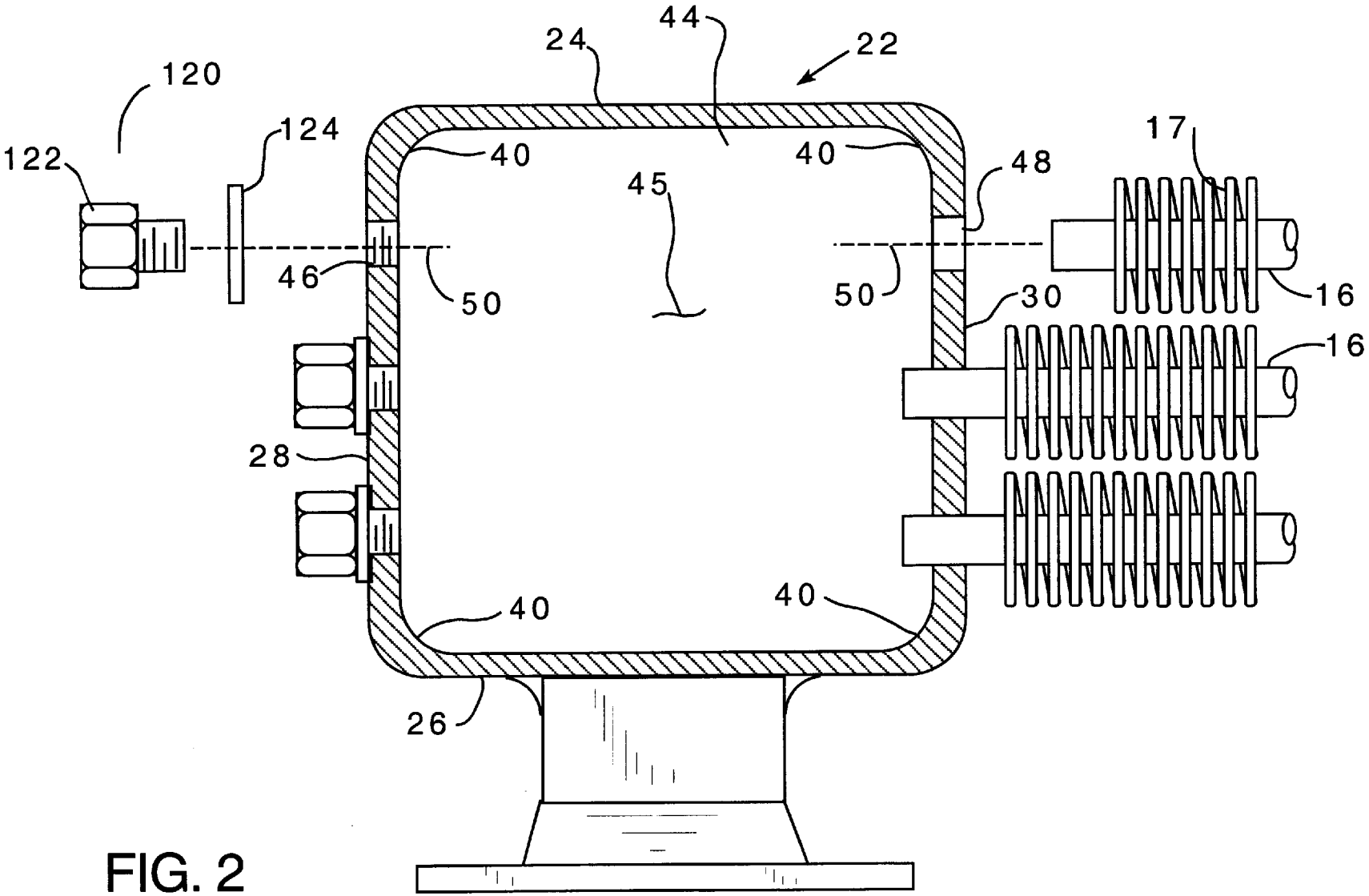
FIG. 2 is a cross-sectional view of a unitary body quadrilateral header assembly.

As shown in FIG. 1, a heat exchanger assembly 1 includes two unitary quadrilateral body header assemblies or header boxes 10, that is, a first header box 12 and a second header box 14. The header boxes 12, 14 are held in a spaced relation. The heat exchange assembly 1 further includes a plurality of tubes 16 and two couplings 18, 20. The header boxes 12, 14 are generally symmetrical and, as such, only one header box will be described. The header box 12 includes a hollow unitary body 22 having a generally quadrilateral cross section. Thus, the unitary body 22 has a first generally flat side 24 spaced from and generally parallel to a generally flat second side 26. As shown in FIGS. 1 and 2, the first and second sides 24, 26 are generally horizontal. The unitary body 22 also has a third generally flat side 28 spaced from and generally parallel to a generally flat fourth side 30. The third and fourth sides 28, 30 extend generally perpendicular to the first and second sides 24, 26. The third and fourth sides 28, 30 are coupled to each of the first and second sides 24, 26 by rounded corners 40. The first and second sides 24, 26 may be described a first set of spaced, horizontal sides 32 where one side is an upper side 24 and one side is a lower side 26. The third and fourth side 28, 30 may be described as a second set of spaced, vertical sides 34. The horizontal sides 24, 26 are, preferably, between about six and twelve inches in width, and more preferably, about 8.5 inches in width. The vertical sides 28, 30 are, preferably, between about six and twelve inches in width, and more preferably, about 8.5 inches in width. The unitary body 22 is, preferably, formed with no seams.

The header box 12 also has two ends and a first end plate 42 (FIG. 1) and a second end plate 44 (FIG. 2). The end plates 42, 44 are sized to fit snugly within the perimeter at either end of the unitary body 22. The end plates 42, 44 are coupled to the unitary body 22, preferably by welding. When the end plates 42, 44 are coupled to the unitary body 22, a fluid chamber 45 is formed.

The header box 12 also includes a plurality of plug openings 46 on the third side 28 and tube openings 48 on the fourth side 30. Each plug opening 46 is directly opposite a tube opening 48. A centerline 50 passing through each plug opening 46 is also a centerline of an opposed tube opening 48. The alignment of the plug openings 46 and tube openings 48 provides access for attaching the tubes 16 (described below) to each header box 12, 14 through use of an expander tool (not shown) and/or by welding a tube 16 to the header box body 22.

Each header assembly tube 16 may have one or more fins 17 attached thereto. The fins 17 aid in heat exchange between the fluid within the tubes 16 and the fluid outside the tubes 16. The tubes 16 may also have interior fins (not shown) to assist in heat transfer. Each tube 16 is coupled to both box headers 12, 14 at the location of a tube opening 48. Preferably, each tube 16 is expanded to the box headers 12, 14. Each tube 16 is in fluid communication with the fluid chamber 45. As such, a fluid in the first header fluid chamber 45 may pass through the tubes 16 to the second header fluid chamber (not shown).

Figure 3:
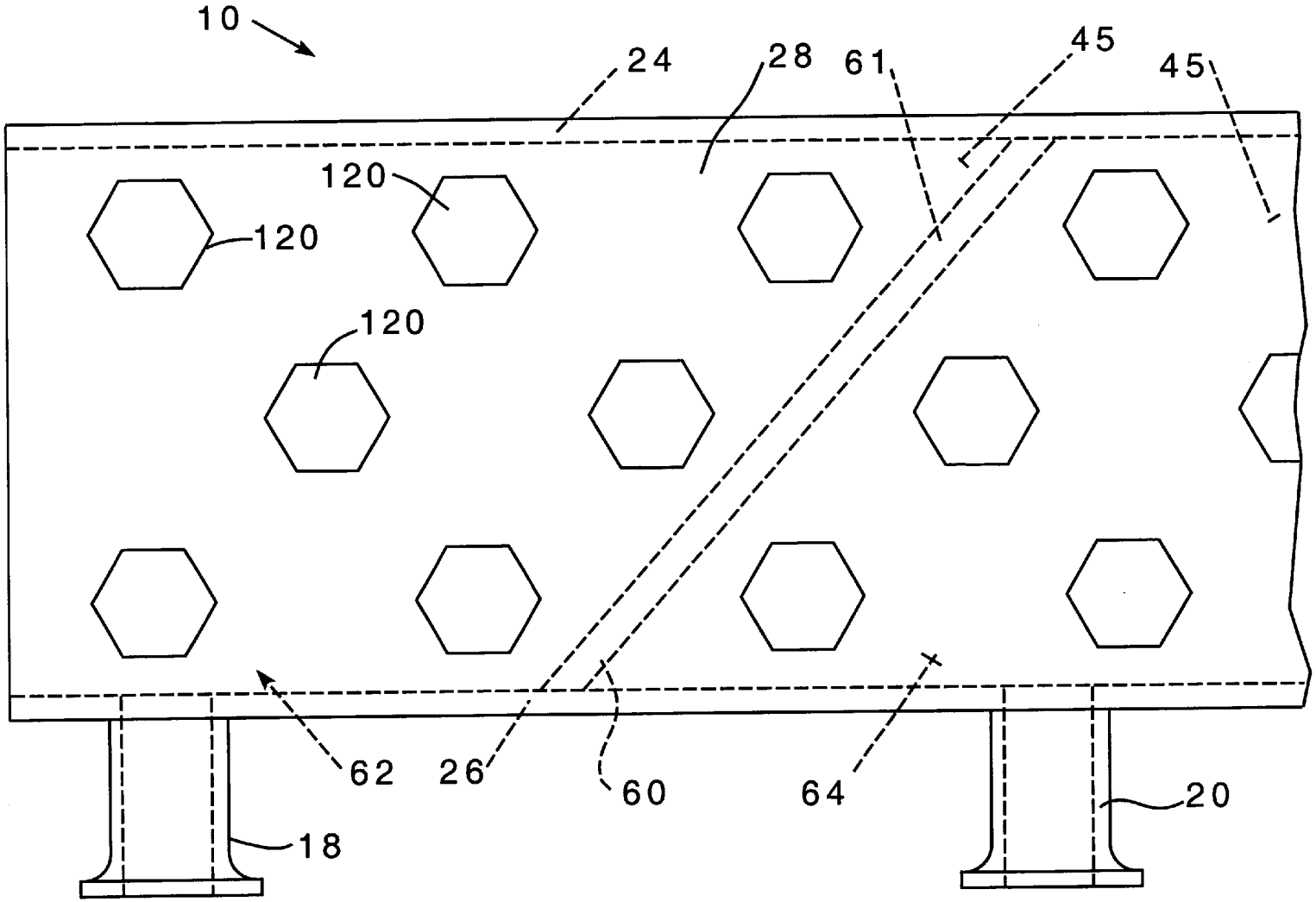
FIG. 3 is a side view of a unitary body quadrilateral header assembly.
Figure 4:
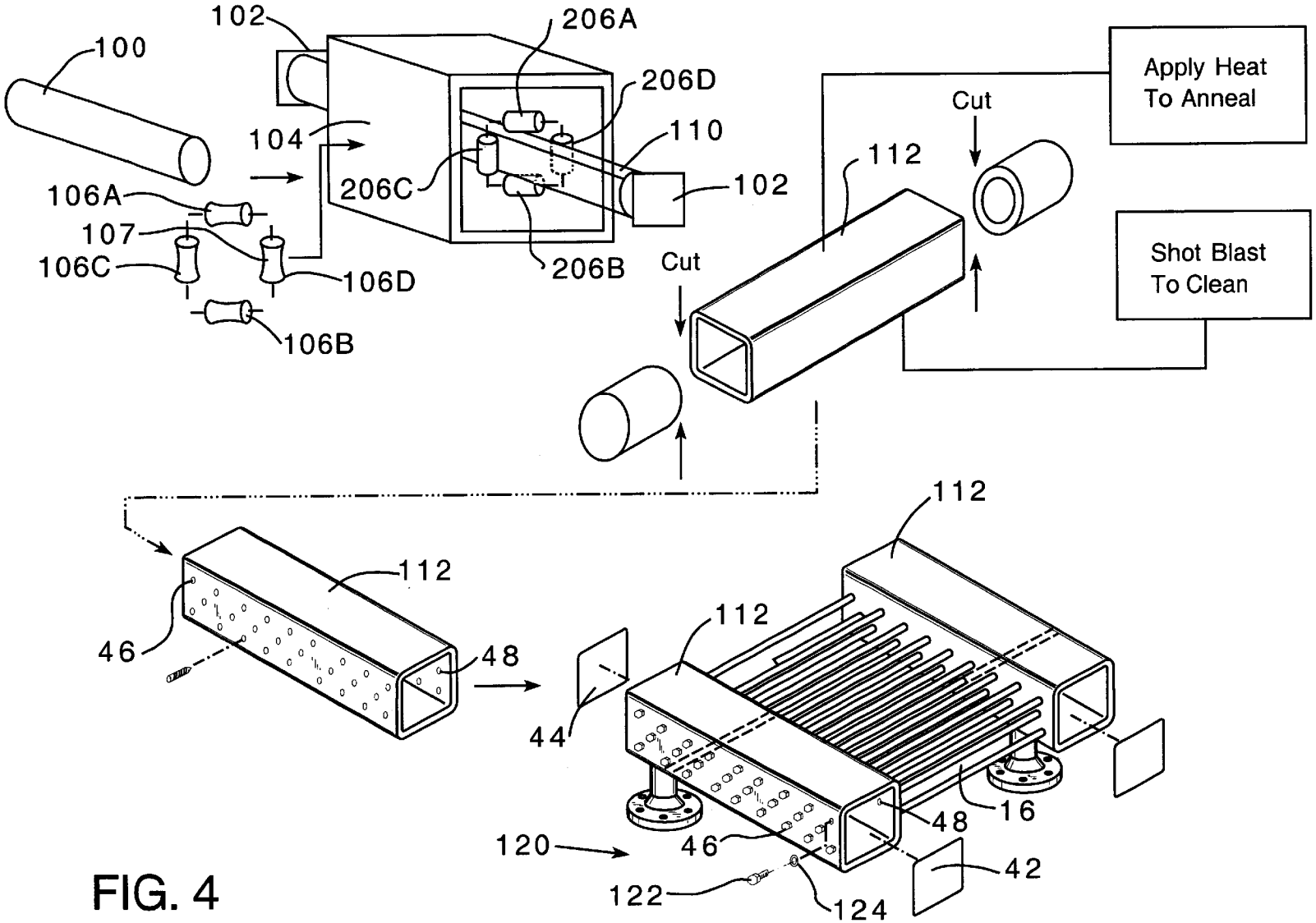
FIG. 4 is a schematic diagram of the manufacturing steps for assembling a unitary body quadrilateral header assembly.

As shown in FIG. 3, at least one pass plate 60 may be disposed within fluid chamber 45. The pass plate includes a generally planar body 61. The pass plate 60 divides the fluid chamber 45 into one or more sub-chambers 62, 64. The pass plate 60 is disposed at an angle relative to the vertical axis of the header box 12, 14. Each pass plate 60 passes between, but does not overlap or cover, the tube openings. The pass plate 60 may be welded to the unitary body 22, thereby sealing the first sub-chamber 62 from the second sub-chamber 64.

The header assembly 10 also includes an inlet coupling 18 and an outlet coupling 20. Both the inlet coupling 18 and the outlet coupling 20 are in fluid communication with a header box fluid chamber 45. Depending on the number of pass plates 60 disposed in the fluid chamber 45 of each header box 12, 14, the inlet coupling 18 and the outlet coupling 20 may be disposed on the same header box 12, as shown in FIG. 3, or on different header boxes 12, 14, as shown on FIG. 1.

For example, in operation, describing the header assembly 10 shown in FIG. 1, a hot fluid enters the header assembly 10 through inlet coupling 18, and travels into the first sub-chamber 62 of the fluid chamber 45 of header box 12 located on a first side of the first header box pass plate 60A. The hot fluid then travels through a first portion of the tubes 16A to the second header box 14. As the hot fluid travels through the tubes 16, the fluid is cooled by transferring heat to the fluid outside of the tubes 16. The second header box pass plate 60B prevents the hot fluid from traveling directly to the outlet coupling 20. Instead, the hot fluid travels through a second portion of the tubes 16B back to the first header box 12 into the second sub-chamber 64 of the fluid chamber 45 of first header box 12, located on a second side of the first header box pass plate 60A. Again, as the hot fluid travels through the tubes 16, the fluid is cooled by transferring heat to the fluid outside of the tubes 16. The fluid then travels through a third portion of the tubes 16C back to the second header box 14, being cooled further by traveling through the tubes 16. The cooled fluid then exits the header assembly 10 through outlet coupling 20.

The unitary quadrilateral body header assembly 10 is constructed using a seamless quadrilateral pipe 112. The method of constructing the unitary quadrilateral body header assembly 10 begins with forming the seamless quadrilateral pipe 112. Initially, as shown schematically in FIG. 3, the pipe 100 is a common, seamless round pipe, for example Seamless SA106grB pipe manufactured by North Star Co., a division of Cargill Steel, 8603 Sheldon Road, Houston, Tex. 77049. The pipe 100 may be mounted on one or more dies 102 structured to pass through a press. The pipe 100 is then passed through a hydraulic forming roll 104, commonly called a "Turks Head" roll, having a first set of four opposing rollers 106A, 106B, 106C, 106D, and a second set of four opposing rollers 206A, 206B, 206C, and 206D. Each set of rollers 106A, 106B, 106C, 106D and 206A, 206B, 206C, and 206D are disposed in generally perpendicular pairs. Each roller in the first set of rollers 106A, 106B, 106C, 106D have an arced surface 107. The arced surface 107 has radius that is greater than the radius of the pipe 100. Each roller in the second set of rollers 206A, 206B, 206C, and 206D is generally cylindrical. Both sets of rollers 106A, 106B, 106C, 106D and 206A, 206B, 206C, and 206D contact the round pipe 100 and deform the round pipe 100 to have a quadrilateral shaped portion 110. The pipe 100 may be passed through the forming roll 104 several times.

Once the quadrilateral shaped portion 110 is formed, the pipe is taken off of the dies 102 and the round end portions are cut off. The quadrilateral shaped portion 110 is then annealed to remove any internal stress caused by the forming roll 104. Mill scale from the annealing process can be removed by shot blasting the quadrilateral shaped portion 110. Thus, what remains is a seamless quadrilateral pipe 112. The sides of the quadrilateral pipe have a thickness between about 0.5 and 1.25 inches. The quadrilateral pipe 112 is then cut to the appropriate size for a box header 12, 14. The plug openings 46, tube openings 48, and a coupling opening are then drilled and/or cut in the quadrilateral pipe 112. The plug openings 46 are then tapped. The end plates 42, 44 and any pass plates 60 are welded to the quadrilateral pipe 112. A coupling 18 is then attached, preferably by welding, to the quadrilateral pipe 112. The partially complete assembly 10 may be heated to relieve any stress caused by the assembly process. The tubes 16 are then attached to two quadrilateral pipes 112, extending therebetween, at the tube openings 48 by known methods, such as an expansion tool or seal welding. The header assembly 10 is completed by installing plugs 120, preferably a bolt 122 and a gasket 124, in the taped plug openings 46.

While specific embodiments of the invention have been described in detail, it will be appreciated by those skilled in the art that various modifications and alternatives to those details could be developed in light of the overall teachings of the disclosure. For example, the inlet and outlet couplings 18, 20 are typically on the lower of the two horizontal sides 26. The inlet and outlet couplings 18, 20 may, however, be on any side 24, 26, 28, 30. Accordingly, the particular arrangements disclosed are meant to be illustrative only and not limiting as to the scope of invention which is to be given the full breadth of the claims appended and any and all equivalents thereof.

What is claimed is:

1. A method of making a unitary header box for a heat exchange assembly comprising the following steps:

(a) forming a seamless quadrilateral pipe;

(b) drilling plug openings and tube openings in said seamless quadrilateral pipe;

(c) welding at least one inlet/outlet coupling to said seamless quadrilateral pipe; and (d) welding pass plates and end plates to said quadrilateral pipe.

2. The method of claims 1 wherein, said step of forming a seamless quadrilateral pipe includes the step of:

(a) passing a seamless round pipe through a forming roll having two sets of four rollers, said rollers in generally perpendicular pairs, whereby a portion of said round pipe is deformed to have a quadrilateral shaped portion.

3. The method of claim 2 wherein, said step of forming a seamless quadrilateral pipe includes the further steps of:

(a) cutting off the non-quadrilateral shaped end portions of said pipe;

(b) annealing said quadrilateral shaped portion;

(c) shot blasting said quadrilateral shaped portion to remove any mill scale from said annealing process; and (d) cutting said quadrilateral shaped portion to an appropriate size for a box header.

* * * * *

UNITED STATES PATENT AND TRADEMARK OFFICE

CERTIFICATE OF CORRECTION

PATENT NO. : 6,523,260 B2
DATED : February 25, 2003
INVENTOR(S) : Richard Dwayne Kelsey It is certified that error appears in the above-identified patent and that said Letters Patent is hereby corrected as shown below:

Column 6,
Line 3, “claims” should read -- claim --.

Signed and Sealed this

Twenty-ninth Day of April, 2003

JAMES E. ROGAN
*Director of the United States Patent and Trademark Office*